US005143810A

United States Patent [19]

Nozawa et al.

[11] Patent Number: 5,143,810

[45] Date of Patent: Sep. 1, 1992

[54] MAGNETIC TONER FOR DEVELOPING ELECTROSTATIC IMAGE

[75] Inventors: Keita Nozawa; Seiichi Takagi, both of Yokohama, Japan

[73] Assignee: Canon Kabushiki Kaisha, Tokyo, Japan

[21] Appl. No.: 530,155

[22] Filed: May 29, 1990

[30] Foreign Application Priority Data

May 30, 1989 [JP] Japan ..... 1-134683

[51] Int. Cl.[5] ..... G03G 9/083; G03G 9/107; G03G 9/00

[52] U.S. Cl. ..... 430/106.6; 430/109; 430/111

[58] Field of Search ..... 430/106, 106.6, 109, 430/111

[56] References Cited

U.S. PATENT DOCUMENTS

| | | | |
|---|---|---|---|
| 3,900,258 | 8/1975 | Hoppner et al. | 355/51 |
| 3,900,302 | 8/1975 | Langlois et al. | 65/8 |
| 4,220,698 | 9/1980 | Brynko et al. | 430/107 |
| 4,282,302 | 8/1981 | Makino et al. | 430/107 |
| 4,386,577 | 6/1983 | Hosono et al. | 118/657 |
| 4,857,432 | 8/1989 | Tanikawa et al. | 430/106 |
| 4,935,325 | 6/1990 | Kuribayashi et al. | 430/106.6 |
| 4,939,060 | 7/1990 | Tomiyama et al. | 430/106.6 |

FOREIGN PATENT DOCUMENTS

| | | |
|---|---|---|
| 119200 | 10/1974 | Japan . |
| 52-94140 | 8/1977 | Japan . |
| 54-043037 | 4/1979 | Japan . |
| 57-77031 | 5/1982 | Japan . |
| 58-60753 | 4/1983 | Japan . |
| 59-220747 | 12/1984 | Japan . |
| 60-6952 | 1/1985 | Japan . |
| 63-128356 | 5/1988 | Japan . |

*Primary Examiner*—Marion E. McCamish
*Assistant Examiner*—S. C. Crossan
*Attorney, Agent, or Firm*—Fitzpatrick, Cella, Harper & Scinto

[57] ABSTRACT

A magnetic toner for developing an electrostatic image comprises a binder resin and a spherical magnetic powder. The spherical magnetic powder comprises spherical magnetic particles. The spherical magnetic particle has a surface layer having composition different from its core. The surface layer is formed of a ferrite having an oxide of a divalent metal other than iron in an amount of from 1.5 to 13 mol % in terms of divalent metal ion.

11 Claims, 1 Drawing Sheet

MAGNETIC TONER FOR DEVELOPING ELECTROSTATIC IMAGE

BACKGROUND OF THE INVENTION

1. Field of the Invention

The present invention relates to a magnetic toner for developing an electrostatic image, containing spherical ferrite particles.

2. Related Background Art

Dry developing processes hitherto used in image forming processes such as electrophotography and electrostatic recording are chiefly grouped into a process in which a two-component developer is used and a process in which a one-component developer is used.

In the developing process that uses a two-component developer, a mixed developer comprising carrier particles and toner particles is used. There is usually the problem that a mixing ratio of the toner and carrier varies with progress of developing or the image quality of a toner image is lowered because of deterioration or the like of carrier particles.

On the other hand, the developing process that uses a one-component developer contains no carriers, and hence is free from the above problem of the variation of a mixing ratio or the deterioration of carrier particles. Thus, it is an electrostatic-image developing process capable of forming a toner image faithful to an electrostatic image of the toner image and also capable of achieving stable image quality. In particular, a process in which a developer comprising toner particles having magnetic properties is used can often bring about excellent results.

Such a developing process is exemplified by a process proposed in U.S. Pat. No. 3,900,258, in which development is carried out using a magnetic toner having an electrical conductivity. In this developing process, a conductive magnetic developer is supported on a cylindrical conductive sleeve having a magnet in its interior, and this developer is brought into contact with a recording medium having an electrostatic image to carry out development. Here, in a developing section, conductive magnetic toner particles form a conductive path between the surface of the recording medium and the surface of the sleeve, where electric charges are introduced into the conductive magnetic toner particles from the sleeve through the conductive path, and, because of Coulomb force acting between an electrostatic image and conductive magnetic toner particles, the conductive magnetic toner particles adhere to the electrostatic image. The electrostatic image can be thus developed. While the developing process in which a conductive magnetic toner is used is a superior process free of the problems involved in the conventional developing process in which a two-component developer is used, it has the problem that the toner, which is conductive, makes it difficult to electrostatically transfer a toner image from a recording medium to a transfer medium such as plain paper.

As a developing process in which a high-resistivity magnetic toner capable of electrostatic transfer is used, Japanese Patent Laid-open No. 52-94140 disclosed a developing process in which the dielectric polarization of a toner is utilized. Such a process, however, has the problem that the rate of development is fundamentally too low to obtain a satisfactory density in a developed image.

As a developing process in which a high-resistivity magnetic toner is used, a process is known in which magnetic toner particles are triboelectrically charged by friction between magnetic toner particles themselves or friction between magnetic toner particles and a sleeve to carry out development. In such a developing processes, however, the contact between toner particles and a friction member tends to be so few that the triboelectric charging between toner particles may be insufficient.

Japanese Patent Laid-open No. 54-43037 (corresponding to U.S. Pat. No. 4,386,577) discloses a proposal for a novel developing process which is an improvement of a conventional developing process. In this developing process, a magnetic toner is coated on a sleeve in a very small thickness, the resulting magnetic toner layer is triboelectrically charged, and is then brought very close, and also face-to-face without contact, to an electrostatic image in the presence of a magnetic field. The electrostatic image is thus developed. According to this process, a superior image can be obtained because of the advantages that the application of a magnetic toner on a sleeve in a very small thickness increases the opportunity of contact between the sleeve and the toner to enable sufficient triboelectric charging. Since the toner is supported by the action of a magnetic force, and a magnet and the toner is moved in a relative fashion, the agglomeration between toner particles can be released and a sufficient friction can be attained between toner particles and the sleeve. Since the development is carried out while the toner is supported by the action of a magnetic force and the magnetic toner layer is brought face-to-face to an electrostatic image without contact therewith, ground fogging can be prevented.

In recent years, with a rapid progress in copying machines and printers that employ electrophotography and digital latent image techniques, toners are required to have higher performance. Particularly in printers, because of the development of a digital image, it is required as a matter of course that toner images with the same quality can be repeatedly obtained.

Besides characters, printers must be also able to print out images such as graphic images and photographic images. Hence, they are required to have a higher reproducibility of halftone images and fine line images than the conventional printer. In particular, some of recent printers can form an image with 400 dots or more per inch, where a digital latent image on a photosensitive member has become more detailed. Thus, a higher reproducibility of halftone images and fine lines is required in development. In addition, it is increasingly demanded that an image with a high image density and a high image quality must be obtained even in varied environments.

Under the circumstances as stated above, a further improvement is desired in the magnetic toners conventionally used.

In order to obtain a high image density in various environments, it is important to stably keep the amount of triboelectric charge of magnetic toner particles to an appropriate value. In this regard, some methods have been proposed, including, for example, a method in which a compositional improvement is made on a magnetic powder so that the electrical resistance of the magnetic powder can be increased, or the particle surfaces of a magnetic powder are modified so that the water absorption properties (making them more hydrophobic) of the magnetic powder can be improved. This is based on the idea that, with an increase in the electrical resistance or hydrophobicity of a magnetic powder, the charge of a magnetic toner can be more stably retained in the case of a magnetic toner that employs such a magnetic powder.

Among the above proposals, a comparison can be made between the method in which the particle surfaces of a magnetic powder are modified and the method in which the magnetic powder itself is compositionally changed. The former additionally requires the step of surface treatment on the magnetic powder when it is prepared, resulting not only in an increase in cost but also an increase in steps. This produces a possibility that the performance may greatly differ between production lots. From these viewpoints, the latter method in which the magnetic powder itself is compositionally changed can be said to be a better method.

Proposals on the latter method includes those disclosed in Japanese Patent Laid-open No. No. 55-65406 (corresponding to U.S. Pat. No. 4,282,302) and No. 57-77031.

The Japanese Patent Laid-open No. 55-65406 discloses a magnetic toner employing spinel type ferrite particles containing a compound of a divalent metal selected from Mn, Ni, Mg, Cu, Zn and Cd. The Japanese Patent Laid-open No. 57-77031 discloses a process for preparing a black, cubic spinel type iron oxide comprising a solide solution with zinc, which is a wet method, particularly characterized in that a zinc ion is added in the course of oxidation of a ferrous salt solution.

The magnetic toner in which the magnetic powder as in the above two proposals is used undoubtedly exhibits a higher performance than conventional toners in view of the advantages that the charge of the toner can be kept in an appropriate amount and in a more stable and the image density can be made higher. However, black spots of the toner may be formed around an image and hence can not answer the new demand for a higher reproducibility of halftone dots or fine lines. This is for one thing ascribable to its coercive force Hc which is not less than 100 Oe.

On the other hand, with regard to an attempt to enhance the reproducibility of halftone dots or fine lines, Japanese Patent Laid-open No. 59-220747 discloses a proposal that a magnetic toner can be less agglomerated, with a high fluidity, and a sharp and excellent toner image can be obtained when a magnetic material used in the toner image has a small coercive force. In this proposal, however, it is proposed to use iron or an iron alloy as a magnetic powder having a small coercive force. The iron or iron alloy has, for example, an electrical resistivity of $10^{-5}$ Ωcm, which is much lower than ferrite, and hence is not preferable when one takes into account that the triboelectric properties of a magnetic toner must be stabilized.

SUMMARY OF THE INVENTION

An object of the present invention is to provide a magnetic toner that has solved the above problems.

Another object of the present invention is to provide a magnetic toner containing magnetic powder having good magnetic properties.

Still another object of the present invention is to provide a magnetic toner having superior environmental stability.

A further object of the present invention is to provide a magnetic toner having superior durability to image production on a large number of sheets.

The above objects of the present invention can be achieved by a magnetic toner for developing an electrostatic image, comprising a binder resin and a spherical magnetic powder, wherein;

said spherical magnetic powder comprises a spherical magnetic particle;

the spherical magnetic particle has a surface layer having composition different from its core; and the surface layer is formed of a ferrite having an oxide of a divalent metal other than iron in an amount of from 1.5 to 13 mol % in terms of divalent metal ion.

BRIEF DESCRIPTION OF THE DRAWINGS

In the accompanying drawings.

DETAILED DESCRIPTION OF THE INVENTION

The magnetic toner of the present invention comprises at least a binder resin and a spherical magnetic powder. The magnetic powder comprises spherical magnetic particles. In the present invention, the spherical magnetic powder refers to a magnetic powder containing not less than 50% by number, preferably 70% by number, and more preferably 80% by number, of spherical magnetic particles in which the major axis and the minor axis of a magnetic particle are in a ratio of from 1 to 1.3, and preferably from 1 to 1.2.

Figure 1:
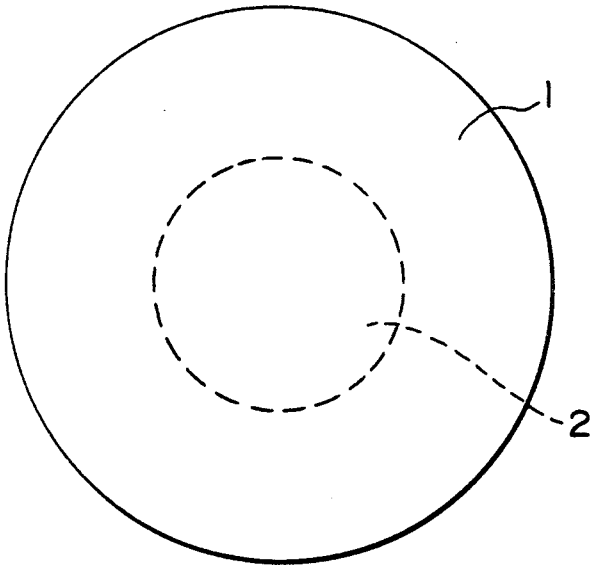
FIG. 1 diagramatically illustrates a spherical magnetic particle comprised of a zinc ferrite layer 1 and a magnetite core 2, as used in Example 1.

As shown in FIG. 1, the spherical magnetic particle used in the present invention is comprised of a surface layer 1 and a core 2. The surface layer is formed of a ferrite which is compositionally different from the core 2.

The ferrite surface layer of the spherical magnetic powder contains an oxide component of a divalent metal other than an iron oxide component. The oxide component should be contained in an amount of from 1.5 mol % to 13 mol %, and preferably from 2 mol % to 10 mol %, in terms of divalent metal ion, based on the iron oxide component (in terms of iron ion) in the ferrite surface layer.

If the oxide component of a divalent metal other than an iron oxide component is in an amount less than 1.5 mol % in terms of metal iron ($M^+$), it is difficult to increase the electrical resistivity of the magnetic powder. If the oxide component is in an amount more than 13 mol %, the magnetic properties (in particular, magnetization) may become too small to be used for a magnetic toner. Hence, such a magnetic toner tends to cause fog, and also the magnetic powder may turn reddish.

The ferrite that constitutes the surface layer 1 should preferably be in an amount of from 1 to 90 mol %, and more preferably from 5 to 85 mol %, based on 100 mol % of the whole magnetic particle.

For example, in Example 1 as will be described later, used is a spherical magnetic powder comprising a spherical magnetic particle whose core 2 is formed of 20 mol % of magnetite ($Fe_3O_4$) and surface layer 1 is formed of 80 mol % of zinc-iron ferrite $[(ZnO)_{0.15}\cdot(FeO)_{0.85}\cdot Fe_2O_3]$.

In the case where the oxide of a divalent metal other than iron is uniformly contained in a magnetic particle, an attempt to increase the electrical resistivity of magnetic particles by incorporating a divalent metal oxide in a large amount may bring about the problem that the saturation magnetization of the magnetic particles becomes smaller. To cope with this problem, the surfaces of magnetic particles may be selectively formed of a ferrite in combination with cores which are compositionally different from surface layers, so that the magnetic properties of the magnetic powder can be made not to deviate from an appropriate value.

The oxide component of a divalent metal other than an iron oxide component, constituting the ferrite that forms the surface layer of a magnetic particle, may preferably include an oxide of a divalent metal selected from the group consisting of Mn, Ni, Cu, Zn and Mg. Of these, zinc ferrite formed of an oxide of Zn and iron oxide is particularly preferred in view of its effect of increasing initial permeability. The higher the initial permeability of magnetic particles is, the greater the saturation magnetization of magnetic particles in a small magnetic field is. Thus, when it is used in a magnetic toner, the magnetic toner is strongly attracted to a magnet contained in a sleeve, making it possible to decrease fog.

The spherical magnetic particle has the major axis and minor axis which are preferably in a ratio of from 1 to 1.3, and more preferably from 1 to 1.2. A magnetic particle having the major axis and minor axis in a ratio more than 1.3 makes it difficult to have a good coercive force. The magnetic powder may preferably have a saturation magnetization (vs. 1 KOe) of from 60 emu/g to 80 emu/g, and more preferably from 65 to 75 emu/g. A saturation magnetization less than 60 emu/g results in a small magnetic restraint of a magnetic toner to the sleeve containing a magnet, tending to cause the fog that contaminates a white ground of a toner image. On the other hand, a saturation magnetization more than 80 emu/g reversely results in an excessively large magnetic restraint of a magnetic toner to lower image density.

The magnetic powder may preferably have a coercive force (Hc) of from 40 to 70 Oe, and more preferably from 45 to 65 Oe. A coercive force more than 70 may make a magnetic agglomerating force of a magnetic toner remain even on a latent image where no magnetic field is present, often causing a lowering of image quality, e.g., a lowering of the reproducibility of fine lines. In the case when the coercive force is less than 40 Oe, the magnetic powder may preferably have a residual magnetization of not more than 10 emu/g, and more preferably not more than 8 emu/g. A residual magnetization more than 10 emu/g may cause a lowering of image quality for the same reasons as in the coercive force.

The magnetic powder may preferably have a BET specific surface area of from 1 $m^2/g$ to 15 $m^2/g$. A BET specific surface area less than 1 $m^2/g$ results in an excessively large particle diameter of the magnetic powder which tends to make larger the scattering of magnetic properties between toner particles. A surface area more than 15 $m^2$ may raise problems for the stability of the magnetic powder.

The divalent metal oxide in the magnetic particle can be determined by IPC (high-frequency inductively coupled plasma) emission spectroscopy for the quantity of divalent metal ions in a dilute solution obtained by completely dissolving magnetic particles as divalent metal ions with hydrochloric acid and appropriately diluting the hydrochloric solution in which magnetic particles have been dissolved. Thus the quantity of the divalent metal component contained in a magnetic particle can be calculated from the quantity of the divalent metal ions.

The quantity of the iron component can be similarly calculated from the quantity of iron ions.

The quantity of the ferrite portion in the surface layer of a magnetic particle can be measured in the following way: Surfaces of magnetic particles in the magnetic powder are dissolved with dilute hydrochloric acid only a small amount, and at that moment, the remaining magnetic powder and the dilute hydrochloric acid solution are separated. The resulting dilute hydrochloric acid solution is subjected to measurement of the quantities of divalent metal ions and iron ions in the same manner as in the above to find the molar percentage of divalent metal ions with respect to iron ions and the molar percentages of the divalent metal oxide and iron oxide components in the magnetic powder, having been dissolved as divalent metal ions and iron ions. This procedure is repeated so that magnetic particles are gradually dissolved from their surfaces, and thus the quantity of a divalent metal ion in each layer of a magnetic particle is successively measured. The total quantity of magnetic particle layers having been dissolved until the quantity of divalent metal ions (for example, zinc ions) with respect to iron ions has come to 1 mol % or less is regarded as the quantity of the ferrite portion (the portion comprising a solid solution with, for example, zinc oxide) present in the surface layer of a magnetic particle.

The form, or the ratio of the major axis to minor axis, of a magnetic particle can be measured by the following method: A photograph of about 20,000 magnifications of magnetic particles is taken using a transmission electron microscope. Here, the photograph is taken in several sheets from different views in the state where the particles are separated individually. The diameter in the longest direction of a particle of the magnetic powder, taken in a photograph, is regarded as a major-axis diameter and the diameter in the shortest direction is regarded as a minor-axis diameter. Thus the ratio of the major axis to minor axis of the particle is expressed by (major-axis diameter)/(minor-axis diameter). This ratio is measured for at least 500 particles for one sample. An average value thereof is regarded as the ratio of the major axis to minor axis of the particle.

Magnetic properties can be measured using a vibrating-sample magnetization meter (manufactured by Toa Kogyo K. K.), by the following method: A sample magnetic material is weighted out in an amount of about 1 g, which is then put in a given cell, and the cell is placed in a magnetic circuit. An external magnetic field is gradually made larger from the state in which no external magnetic field is present (H=0 Oe) until the external magnetic field reaches 1 kOe. Next, the external magnetic field is gradually made smaller, and a magnetic field of reverse direction is gradually made larger through the state in which no external magnetic field is present, until the intensity of the magnetic field reaches 1 KOe. At this time, changes in magnetization with respect to the magnetic field are recorded on a recorder, with the magnetic field intensity as abscissa and the amount of magnetization as ordinate. The saturation magnetization, residual magnetization, and coercive force are read from a chart recorded using the recorder.

The spherical magnetic powder used in the present invention may preferably have an electrical resistivity of from $10^4$ to $10^8$ Ω. cm.

The electrical resistivity of the magnetic powder can be measured by the following method: A magnetic material in an amount of 10 g is put in a holder, to which a pressure of 600 kg/cm$^2$ is applied. After release of the pressure, an electrode plate is inserted, and fitted under application of a pressure of 150 kg/cm$^2$. A voltage of 100 V is applied to the electrode plate, and an electric current value is measured after 3 minutes to determine the resistivity of a sample used for measurement. The electrical resistivity of the magnetic powder is determined by calculation from the thickness, surface area and resistivity of the sample used for measurement.

The binder resin constituents of the magnetic toner of the present invention includes polystyrene; homopolymer of styrene derivatives and copolymers thereof as exemplified by poly(p-chlorostyrene), polyvinyltoluene, a styrene/p-chlorostyrene copolymer, and a styrene/vinyltoluene copolymer; copolymers of styrene and acrylates as exemplified by a styrene/methyl acrylate copolymer, a styrene/ethyl acrylate copolymer, and a styrene/n-butyl acrylate copolymer; copolymers of styrene and methacrylates as exemplified by a styrene/methyl methacrylate copolymer, a styrene/ethyl methacrylate copolymer, and a styrene/α-butyl methacrylate copolymer; terpolymers of styrene, acrylates and methacrylates; styrene copolymers of styrene and other vinyl monomers as exemplified by a styrene/acrylonitrile copolymer, a styrene/vinyl methyl ether copolymer, a styrene/butadiene copolymer, a styrene/vinyl methyl ketone copolymer, a styrene/acrylonitrile/indene copolymer, and a styrene/maleate copolymer; polymethyl methacrylate, polybutyl methacrylate, polyvinyl acetate, polyesters, polyamides, epoxy resins, polyvinyl butyral, polyacrylic acid, phenol resins, aliphatic or alicyclic hydrocarbon resins, petroleum resins, and chlorinated paraffin. These may be used alone or in the form of a mixture.

A binder resin used in a toner which is applied in pressure fixing includes a low-molecular polyethylene, a low-molecular polypropylene, an ethylene/vinyl acetate copolymer, an ethylene/acrylate copolymer, higher fatty acids, polyamide resins, and polyester resins. These may be used alone or in the form of a mixture.

Preferable results can be obtained when the polymer, copolymer, or polymer blend used as the binder resin contains a vinyl aromatic monomer as typified by styrene, or an acrylic monomer, in an amount of not less than 40 wt. %.

In the present invention, the magnetic powder comprising the magnetic particles as described above may preferably be used in an amount of from 20 to 60 wt. % in a magnetic toner. An amount more than 60 wt. %, of the magnetic powder may result in a lowering of the electric properties or fixing properties of the magnetic toner, tending to cause a light image density. An amount less than 20 wt. %, of the magnetic powder tends to result in insufficient magnetic properties of the magnetic toner, tends to bring about the formation of a toner image having fog and an uneven image, and tends to make unsatisfactory the sleeve delivery performance, resulting in a lowering of the image density of a toner image.

A charge controlling agent, a coloring agent and a fluidity improver may also optionally be added in the magnetic toner of the present invention. The charge controlling agent and the fluidity improver may be mixed with (externally added to) the magnetic toner. The charge controlling agent includes metal-containing dyes and nigrosine. The coloring agent includes conventionally known dyes and pigments. The fluidity improver includes colloidal silica, hydrophobic colloidal silica, and fatty acid metal salts.

For the purpose of filling, a filler such as calcium carbonate or fine powdery silica may also be mixed in the magnetic toner in an amount ranging from 0.5 to 20 wt. %. A fluidity improver such as Teflon fine powder may also be mixed so that magnetic toner particles can be prevented from mutual agglomeration and their fluidity can be improved. For the purpose of improving release properties of the magnetic toner at the time of heat-roll fixing, a waxy material such as a low-molecular polyethylene, a low-molecular polypropylene, a microcrystalline wax, carnauba wax, or sasol wax may still also be added in the magnetic toner in an amount of from about 0.5 to about 5 wt. %.

The magnetic toner of the present invention can be produced by a process comprising melt kneading toner constituent materials with a heat kneader such as a heat roll, a kneader or an extruder, thereafter cooling the heat-kneaded product, mechanically crushing the cooled product, finely pulverizing the crushed product with an impact mill such as a jet mill, and then classifying the finely pulverized product; a process comprising dispersing materials such as magnetic powder in a binder resin solution, followed by spray drying; or a process for preparing a toner by polymerization, comprising mixing given materials in polymerizable monomers that constitute a binder resin to give a polymerizable monomer composition, and dispersing the polymerizable monomer composition in an aqueous medium, followed by suspension polymerization to obtain a magnetic toner.

EXAMPLES

The present invention will be described below in greater detail by giving Examples.

Preparation Example 1 for a Magnetic Powder Comprising a Spherical Magnetic Particle Having a Ferrite Layer In 1 l of an aqueous 2M-$FeSO_4$ solution, an aqueous 4M-NaOH solution was added until the pH was 7.5, and $Fe(OH)_2$ was formed at 80° C. While maintaining the above aqueous solution to 80° C., the solution was bubbled with air to initiate oxidation. After 1.5 hour from the initiation of oxidation, an aqueous $Zn(OH_2)$ neutralized by the addition of 1 l of 0.3M-NaOH was slowly dropwise added to 1 l of an aqueous 0.15M-$ZnSO_4$ solution over a period of 5 hours. The temperature of the aqueous solution was maintained at 80° C. also in the course of the addition, and the pH was maintained at 7.5. After a lapse of 5.5 hours from the initiation of the oxidation, 4M-NaOH was again added to adjust the pH of the reaction mixture to 9.5. After 8 hours from the initiation of the oxidation, the reaction was stopped, and the reaction mixture was filtered and then dried to give a spherical magnetic powder comprising spherical magnetic particles.

Preparation Example 2 for a Magnetic Powder Comprising a Spherical Magnetic Particle Having a Ferrite Layer Preparation Example 1 was repeated except for using 1 l of an aqueous 0.1M-$ZnSO_4$. Thus a spherical magnetic powder comprising spherical magnetic particles was obtained. The resulting spherical magnetic particles each had a surface layer formed of a ferrite $[(ZnO)_{0.15}\cdot(FeO)_{0.85}\cdot Fe_2O_3]$ having 5 mol % of zinc oxide, and a core formed of magnetite ($Fe_3O_4$).

EXAMPLE 1

Using an extruder, 60 parts by weight of spherical magnetic powder A (Zn content: 5 mol %; mol % of ferrite portion: 80 mol %; core: magnetite; ratio of major axis to minor axis: 1.05) containing not less than 80% by number of spherical magnetic particles and having an electrical resistivity of $4\times10^5\Omega$.cm, 100 parts by weight of a styrene/n-butyl acrylate copolymer (copolymerization ratio: 80:20), 3 parts by weight of a low-molecular polypropylene and 2 parts by weight of a negative-charge controlling agent were melt-kneaded. The kneaded product was cooled, and then the cooled product was crushed with a cutter mill to give particles of a particle diameter of 2 mm or less. Subsequently the crushed product was finely pulverized with a jet mill, followed by classification using an air classifier to give a magnetic toner with particle diameters of from 3 to 20 μm.

A one-component magnetic developer was prepared by mixing 100 parts by weight of the resulting magnetic toner and 0.4 part by weight of hydrophobic silica, and was then subjected to the following development.

A laser beam printer (LBP-SX, manufactured by Canon Inc.) in which an OPC (organic photoconductor) layer was used as a photosensitive member was modified from 400 dpi to 600 dpi in picture element density, and its developer feeding system was further modified. To a developing unit of the modified machine thus obtained, the above one-component developer was fed, and image production tests were carried out under usual image production conditions in an environment of a temperature of 23.5° C. and a humidity of 60% RH.

In the above image production tests, the initial image density and halftone reproducibility were good, and there were seen no black spots of a magnetic toner on a non-image area and also no fog, thus giving sufficiently good toner image quality. Durability tests for 8,000 sheets were also carried out in order to examine development durability. As a result, no abnormal toner images were produced.

Similar image production tests were carried out in a high-temperature high-humidity atmosphere (35° C., 90% RH). As a result, good results were obtained in both the image density and image quality.

EXAMPLES 2 TO 5, COMPARATIVE EXAMPLES 1, 2

Example 1 was repeated to prepare magnetic toners, except for using as magnetic powders the magnetic powders having the properties as shown in Table 1. The same tests as in Example 1 were also carried out. Results obtained are shown in Table 1.

In the table, the fog, black spots around images, durability, and halftone reproductibility were evaluation in the following manner.

Fog

The state of fogging of toner images was judged by visual observation.

5: Excellent (substantially no fog).
4: Intermediate between 5 and 3.
3: Fairly good (fog is seen, but little affects image quality).
2: Intermediate between 3 and 1.
1: Bad (fog is seen, greatly affecting image quality).

Black Spots Around Image

The state of black spots of toner around images was judged by visual observation.

5: Excellent (substantially no black spots around images.)
4: Intermediate between 5 and 3.
3: Fairly good (black spots of toner are seen, but little affects image quality).
2: Intermediate between 3 and 1.
1: Bad (black spots of toner around images are seen, greatly affecting image quality).

Durability

Continuous image reproduction tests were carried out to evaluate the number of sheets on which good toner images were formed.

5: Good images can be produced on not less than about 8,000 sheets.
4: Good images can be produced up to about 6,000 sheets.
3: Good images can be produced up to about 4,000 sheets.
2: Good images can be produced up to about 2,000 sheets.
1: Good images can be produced up to about 1,000 sheets.

Halftone Reproducibility

Figure 2:
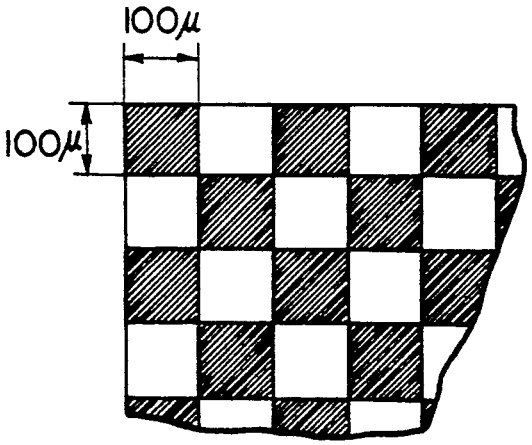
FIG. 2 is a partial view to show an image pattern used for evaluating the halftone reproducibility of a magnetic toner.

A checker pattern as shown in FIG. 2 of the accompanying drawings, having 100 black dots, was reproduced to evaluate the development performance of the toner.

5: Not more than 2 black dots are missed.
4: From 3 to 5 black dots are missed.
3: From 6 to 10 black dots are missed.
2: From 11 to 15 black dots are missed.
1: Not less than 16 black dots are missed.

EXAMPLES 6 to 8, COMPARATIVE EXAMPLES 3, 4

Example 1 was repeated to prepared magnetic toners, except for using as magnetic powders the magnetic powders having the properties as shown in Table 2. The same tests as in Example 1 were also carried out. Results obtained are shown in Table 2.

EXAMPLES 9 to 12, COMPARATIVE EXAMPLES 5, 6

Example 1 was repeated to prepare magnetic toners, except for using as magnetic powders the magnetic powders having the properties as shown in Table 3. The same tests as in Example 1 were also carried out. Results obtained are shown in Table 3.

EXAMPLES 13 to 15, COMPARATIVE EXAMPLES 7, 8

Example 1 was repeated to prepare magnetic toners, except for using as magnetic powders the magnetic powders having the properties as shown in Table 4. The same tests as in Example 1 were also carried out. Results obtained are shown in Table 4. Results on an instance in which copper was used as the metal added (Example 15) are shown therein.

TABLE 1

| | Properties of magnetic powder | | | | | | | | | Properties of magnetic toner | | | | |
|---|---|---|---|---|---|---|---|---|---|---|---|---|---|---|
| | Divalent metal | Amount (mol %) | (1) | (2) | Saturation magnetization (emu/g) | Coercive force (Oe) | Bulk density (g/cm³) | Tone | BET spec. surface area (m²/g) | Image density | Fog | (3) | (4) | (5) |
| Example: | | | | | | | | | | | | | | |
| 1 | Zn | 5 | 80 | 1.10 | 73 | 50 | 0.61 | Good | 8.0 | N/N: 1.42 | 5 | 5 | 5 | 5 |
| | | | | | | | | | | H/H: 1.40 | 5 | 5 | 5 | 5 |
| 2 | Zn | 2 | 80 | 1.05 | 72 | 55 | 0.60 | Good | 7.5 | N/N: 1.40 | 5 | 5 | 5 | 5 |
| | | | | | | | | | | H/H: 1.37 | 5 | 5 | 5 | 5 |
| 3 | Zn | 8 | 80 | 1.07 | 70 | 46 | 0.57 | Good | 8.3 | N/N: 1.42 | 5 | 5 | 5 | 5 |
| | | | | | | | | | | H/H: 1.40 | 5 | 5 | 5 | 5 |
| 4 | Zn | 3 | 80 | 1.15 | 69 | 59 | 0.91 | Good | 8.6 | N/N: 1.39 | 5 | 5 | 5 | 5 |
| | | | | | | | | | | H/H: 1.36 | 5 | 5 | 5 | 5 |
| 5 | Zn | 7 | 80 | 1.03 | 71 | 54 | 0.93 | Good | 8.4 | N/N: 1.43 | 5 | 5 | 5 | 5 |
| | | | | | | | | | | H/H: 1.40 | 5 | 5 | 5 | 5 |
| Comparative Example: | | | | | | | | | | | | | | |
| 1 | — | 0 | 0 | 1.39 | 59 | 118 | 0.30 | Good | 7.5 | N/N: 1.40 | 5 | 4 | 5 | 3 |
| | | | | | | | | | | H/H: 1.25 | 4 | 3 | 5 | 2 |
| 2 | — | 0 | 0 | 1.43 | 57 | 127 | 0.58 | Good | 8.0 | N/N: 1.38 | 5 | 4 | 5 | 3 |
| | | | | | | | | | | H/H: 1.23 | 4 | 3 | 5 | 2 |

(1): Amount of ferrite portion
(2): Form (major axis/minor axis ratio)
(3): Black spots around image
(4): Durability
(5): Halftone reproducibility
N/N: Normal temp. normal humidity (23.5° C., 60% RH)
H/H: High temp. high humidity (23.5° C., 60% RH)

TABLE 2

| | Properties of magnetic powder | | | | | | | | Properties of magnetic toner | | | | |
|---|---|---|---|---|---|---|---|---|---|---|---|---|---|
| | Divalent metal | Amount (mol %) | (1) | (2) | Saturation magnetization (emu/g) | Coercive force (Oe) | Bulk density (g/cm³) | Tone | Image density | Fog | (3) | (4) | (5) |
| Example: | | | | | | | | | | | | | |
| 6 | Zn | 2 | 80 | 1.05 | 72 | 55 | 0.60 | Good | N/N: 1.40 | 5 | 5 | 5 | 5 |
| | | | | | | | | | H/H: 1.37 | 5 | 5 | 5 | 5 |
| 7 | Zn | 5 | 80 | 1.10 | 73 | 50 | 0.61 | Good | N/N: 1.42 | 5 | 5 | 5 | 5 |
| | | | | | | | | | H/H: 1.40 | 5 | 5 | 5 | 5 |
| 8 | Zn | 8 | 80 | 1.12 | 70 | 46 | 0.57 | Good | N/N: 1.42 | 5 | 5 | 5 | 5 |
| | | | | | | | | | H/H: 1.40 | 5 | 5 | 5 | 5 |
| Comparative Example: | | | | | | | | | | | | | |
| 3 | Zn | 15 | 80 | 1.07 | 35 | 30 | 0.60 | Poor (reddish) | N/N: 1.45 | 2 | 4 | 4 | 5 |
| | | | | | | | | | H/H: 1.43 | 2 | 4 | 3 | 5 |
| 4 | — | 0 | 0 | 1.03 | 67 | 68 | 0.55 | Good | N/N: 1.39 | 5 | 5 | 5 | 4 |
| | | | | | | | | | H/H: 1.30 | 4 | 5 | 5 | 3 |

(1): Amount of ferrite portion
(2): Form (major axis/minor axis ratio)
(3): Black spots around image
(4): Durability
(5): Halftone reproducibility
N/N: Normal temp. normal humidity (23.5° C., 60% RH)
H/H: High temp. high humidity (23.5° C., 60% RH)

TABLE 3

| | Properties of magnetic powder | | | | | | | | Properties of magnetic toner | | | | |
|---|---|---|---|---|---|---|---|---|---|---|---|---|---|
| | Divalent metal | Amount (mol %) | (1) | (2) | Saturation magnetization (emu/g) | Coercive force (Oe) | Bulk density (g/cm³) | Tone | Image density | Fog | (3) | (4) | (5) |
| Example: | | | | | | | | | | | | | |
| 9 | Zn | 5 | 5 | 1.07 | 68 | 60 | 0.60 | Good | N/N: 1.43 | 5 | 5 | 5 | 5 |
| | | | | | | | | | H/H: 1.40 | 5 | 5 | 5 | 5 |
| 10 | Zn | 5 | 50 | 1.15 | 72 | 55 | 0.58 | Good | N/N: 1.42 | 5 | 5 | 5 | 5 |
| | | | | | | | | | H/H: 1.39 | 5 | 5 | 5 | 5 |
| 11 | Zn | 5 | 80 | 1.10 | 73 | 50 | 0.61 | Good | N/N: 1.42 | 5 | 5 | 5 | 5 |

TABLE 3-continued

| | Properties of magnetic powder | | | | | | | | Properties of magnetic toner | | | | |
|---|---|---|---|---|---|---|---|---|---|---|---|---|---|
| | Divalent metal | Amount (mol %) | (1) | (2) | Saturation magnetization (emu/g) | Coercive force (Oe) | Bulk density (g/cm³) | Tone | Image density | Fog | (3) | (4) | (5) |
| | | | | | | | | | H/H: 1.40 | 5 | 5 | 5 | 5 |
| 12 | Zn | 5 | 90 | 1.03 | 71 | 48 | 0.57 | Good | N/N: 1.40 | 5 | 5 | 5 | 5 |
| | | | | | | | | | H/H: 1.38 | 5 | 5 | 5 | 5 |
| Comparative Example: | | | | | | | | | | | | | |
| 5 | Zn | 0.003 | 0.01 | 1.09 | 67 | 68 | 0.60 | Good | N/N: 1.36 | 5 | 5 | 5 | 4 |
| | | | | | | | | | H/H: 1.29 | 5 | 5 | 4 | 4 |
| 6 | Zn | 5 | 100 | 1.13 | 65 | 65 | 0.62 | Good | N/N: 1.42 | 5 | 5 | 5 | 5 |
| | | | | | | | | | H/H: 1.40 | 5 | 5 | 5 | 4 |

(1): Amount of ferrite portion
(2): Form (major axis/minor axis ratio)
(3): Black spots around image
(4): Durability
(5): Halftone reproducibility
N/N: Normal temp. normal humidity (23.5° C., 60% RH)
H/H: High temp. high humidity (23.5° C., 60% RH)

TABLE 4

| | Properties of magnetic powder | | | | | | | | Properties of magnetic toner | | | | |
|---|---|---|---|---|---|---|---|---|---|---|---|---|---|
| | Divalent metal | Amount (mol %) | (1) | (2) | Saturation magnetization (emu/g) | Coercive force (Oe) | Bulk density (g/cm³) | Tone | Image density | Fog | (3) | (4) | (5) |
| Example: | | | | | | | | | | | | | |
| 13 | Zn | 5 | 80 | 1.10 | 73 | 50 | 0.61 | Good | N/N: 1.42 | 5 | 5 | 5 | 5 |
| | | | | | | | | | H/H: 1.40 | 5 | 5 | 5 | 5 |
| 14 | Zn | 5 | 80 | 1.12 | 70 | 30 | 0.68 | Good | N/N: 1.45 | 5 | 5 | 5 | 5 |
| | | | | | | | | | H/H: 1.40 | 5 | 5 | 5 | 5 |
| Comparative Example: | | | | | | | | | | | | | |
| 7 | Zn | 5 | 80 | 1.42 | 72 | 88 | 0.23 | Good | N/N: 1.35 | 5 | 5 | 4 | 3 |
| | | | | | | | | | H/H: 1.27 | 5 | 5 | 4 | 3 |
| 8 | Zn | 5 | 80 | 1.45 | 72 | 70 | 0.40 | Good | N/N: 1.37 | 5 | 5 | 5 | 3 |
| | | | | | | | | | H/H: 1.26 | 5 | 5 | 4 | 2 |
| Example: | | | | | | | | | | | | | |
| 15 | Cu | 4 | 80 | 1.09 | 73 | 52 | 0.54 | Good | N/N: 1.41 | 5 | 5 | 5 | 5 |
| | | | | | | | | | H/H: 1.40 | 5 | 5 | 5 | 5 |

(1): Amount of ferrite portion
(2): Form (major axis/minor axis ratio)
(3): Black spots around image
(4): Durability
(5): Halftone reproducibility
N/N: Normal temp. normal humidity (23.5° C., 60% RH)
H/H: High temp. high humidity (23.5° C., 60% RH)

What is claimed is:

1. A magnetic toner for developing an electrostatic image, comprising a binder resin and a spherical magnetic powder having a coercive force from 40–70 Oe, wherein;

said spherical magnetic powder comprises spherical magnetic particles;

the spherical magnetic particle has a surface layer having a composition different from its core; and the surface layer is formed of a ferrite having an oxide of a divalent metal other than iron in an amount of from 1.5 to 13 mol % in terms of divalent metal ion.

2. The magnetic toner according to claim 1, wherein said spherical magnetic particle has a major axis/minor axis ratio of from 1 to 1.3.

3. The magnetic toner according to claim 1, wherein said spherical magnetic particle has a major axis/minor axis ratio of from 1 to 1.2.

4. The magnetic toner according to claim 1, wherein said spherical magnetic powder has a coercive force of from 45 to 65 Oe.

5. The magnetic toner according to claim 1, wherein said spherical magnetic particle comprises a surface layer formed of from 1 to 90 mol % of a ferrite and a core formed of from 99 to 10 mol % of a different material.

6. The magnetic toner according to claim 1, wherein said spherical magnetic powder has a BET surface specific area of from 1 to 15 $m^2/g$.

7. The magnetic toner according to claim 1, wherein said spherical magnetic powder is contained in an amount of from 20 to 60 wt. % based on the magnetic toner.

8. The magnetic toner according to claim 1, wherein said spherical magnetic particle comprises a surface layer formed of a ferrite having zinc oxide in an amount of from 1.5 to 13 mol % in terms of zinc ion, and a core formed of magnetite.

9. The magnetic toner according to claim 1, wherein said spherical magnetic particle comprises a surface layer formed of a ferrite having zinc oxide in an amount of from 1.5 to 13 mol % in terms of zinc ion, and a core formed of a ferrite having zinc oxide in an amount of not more than 1 mol % in terms of zinc ion and an oxide of a divalent metal other than zinc.

10. The magnetic toner according to claim 1, wherein said spherical magnetic powder has a saturation magnetization of from 60 to 80 emu/g.

11. The magnetic toner according to claim 1, wherein said spherical magnetic powder has a saturation magnetization of from 65 to 75 emu/g.

* * * * *

UNITED STATES PATENT AND TRADEMARK OFFICE

CERTIFICATE OF CORRECTION

PATENT NO. : 5,143,810

DATED : September 1, 1992

INVENTOR(S) : KEITA NOZAWA, ET AL.

It is certified that error appears in the above-identified patent and that said Letters Patent is hereby corrected as shown below:

COLUMN 1

Line 63, "disclosed" should read --discloses--.

COLUMN 2

Line 7, "processes," should read --process,--.
Line 27, "is" should read --are--.
Line 46, "fine line" should read --fine-line--.

COLUMN 3

Line 19, "includes" should read --include--.
Line 29, "solide" should read --solid--.
Line 37, "stable and" should read --stable state and--.

COLUMN 4

Line 18, "diagramatically" should read --diagrammatically--.
Line 52, "metal iron" should read --metal ion--.

COLUMN 6

Line 55, "weighted" should read --weighed--.

COLUMN 7

Line 18, "constituents" should read --constituent--.

COLUMN 9

Line 67, "evaluation" should read --evaluated--.

UNITED STATES PATENT AND TRADEMARK OFFICE

CERTIFICATE OF CORRECTION

PATENT NO. : 5,143,810

DATED : September 1, 1992

INVENTOR(S) : KEITA NOZAWA, ET AL.

It is certified that error appears in the above-identified patent and that said Letters Patent is hereby corrected as shown below:

COLUMN 12

TABLE 1, "H/H: High temp. high humidity (23.5°C., 60% RH)" should read --H/H: High temp. high humidity (35°C., 90% RH)--.

TABLE 2, "H/H: High temp. high humidity (23.5°C., 60% RH)" should read --H/H: High temp. high humidity (35°C., 90% RH)--.

COLUMN 13

TABLE 3-continued, "H/H: High temp. high humidity (23.5°C., 60% RH)" should read --H/H: High temp. high humidity (35°C., 90% RH)--.

TABLE 4, "H/H: High temp. high humidity (23.5°C., 60% RH)" should read --H/H: High temp. high humidity (35°C., 90% RH)--.

Signed and Sealed this

Fifth Day of October, 1993

Attest:

Bruce Lehman

BRUCE LEHMAN

Attesting Officer

Commissioner of Patents and Trademarks